US007178300B2

(12) United States Patent
Elsing

(10) Patent No.: US 7,178,300 B2
(45) Date of Patent: Feb. 20, 2007

(54) LATCH-TYPE TILE MOUNTING SYSTEM

(75) Inventor: Robert J. Elsing, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 432 days.

(21) Appl. No.: 10/260,326

(22) Filed: Sep. 30, 2002

(65) Prior Publication Data

US 2004/0060253 A1 Apr. 1, 2004

(51) Int. Cl.
*E04B 9/00* (2006.01)

(52) U.S. Cl. ..... 52/476; 52/489.1

(58) Field of Classification Search ..... 52/476, 52/481.2, 489.1, 483.1
See application file for complete search history.

(56) References Cited

U.S. PATENT DOCUMENTS

| | | | | |
|---|---|---|---|---|
| 2,260,178 | A | 10/1941 | Guignon, Jr. | |
| 2,363,327 | A | 11/1944 | Hodgkins et al. | |
| 2,513,716 | A * | 7/1950 | Farr | 52/125.2 |
| 3,103,708 | A | 9/1963 | Pomeroy et al. | |
| 3,195,698 | A | 7/1965 | Codrea | |
| 3,328,927 | A | 7/1967 | Kates | |

(Continued)

FOREIGN PATENT DOCUMENTS

DE 3530714 3/1987

(Continued)

OTHER PUBLICATIONS

Teknion Office Furniture Systems Brochure, undated.

(Continued)

*Primary Examiner*—Tamara L. Graysay
(74) *Attorney, Agent, or Firm*—Boyle Fredrickson Newholm Stein & Gratz, S.C.

(57) ABSTRACT

A latch-type tile mounting system for mounting a tile to the frame of a wall panel. An outwardly extending hook is engaged with the wall panel frame, and includes an outer hook portion. The tile includes a receiver within which the outer hook portion of the hook member is received, and blocking structure that prevents engagement with the outer hook portion. A latch member is movably mounted to the tile over the receiver, and is movable between an open or unlocked position for enabling the outer hook portion to be moved into and out of engagement with the receiver, and a closed or locked position in which the latch member engages the outer hook portion to secure the tile to the frame. The latch member is pivotably movable between its locked and unlocked positions, preferably via a fastener that secures the latch member to the tile. The latch member includes a specially configured opening which receives the outer hook portion of the hook member when the latch member is in its unlocked position, and which defines an engagement edge or surface that is operable to maintain the outer hook portion of the hook member within the receiver when the latch member is in its locked position. The latch member includes an inner stop member and an outer manually engageable tab. The inner stop member engages a surface of the tile to position the latch member in its unlocked position, and the tab engages an outer surface defined by the tile to position the latch member in its locked position.

26 Claims, 3 Drawing Sheets

U.S. PATENT DOCUMENTS 3,377,756 A 4/1968 Polhamus
3,394,507 A 7/1968 Doke
3,418,765 A 12/1968 Propst et al.
3,429,090 A 2/1969 Metelnick
3,430,997 A 3/1969 Propst et al.
3,449,877 A 6/1969 Beckman
3,517,467 A 6/1970 Propst et al.
3,563,577 A * 2/1971 Wittenmayer ..... 52/489.1
3,706,171 A 12/1972 Shayman
3,712,709 A 1/1973 Kenworthy
3,713,257 A 1/1973 Beavers
3,721,050 A 3/1973 Perina
3,733,755 A 5/1973 Butler
3,759,297 A 9/1973 Anderson et al.
3,774,988 A 11/1973 Rogers
3,797,184 A 3/1974 Thompson
3,839,834 A 10/1974 Goddard
3,973,368 A * 8/1976 Moeller ..... 52/476
3,997,220 A 12/1976 Mayer
4,015,378 A * 4/1977 Fava ..... 52/127.8
4,020,604 A 5/1977 Legler et al.
4,031,675 A 6/1977 Roberts et al.
4,043,626 A 8/1977 Propst et al.
4,056,297 A 11/1977 Gartung
4,076,350 A 2/1978 Crist
4,123,879 A 11/1978 Blodee et al.
4,203,639 A 5/1980 VandenHoek et al.
4,224,769 A 9/1980 Ball et al.
4,231,630 A 11/1980 Propst et al.
4,232,183 A 11/1980 Person
4,235,495 A 11/1980 Propst et al.
4,255,610 A 3/1981 Textoris
4,255,611 A 3/1981 Propst et al.
4,257,203 A 3/1981 Propst et al.
4,277,123 A 7/1981 Haworth et al.
4,375,829 A 3/1983 Dorr et al.
4,382,648 A 5/1983 Propst et al.
4,423,573 A 1/1984 Omholt et al.
4,448,003 A 5/1984 Hasbrouch
4,450,970 A 5/1984 Shepherd
4,525,477 A 6/1985 Roantree et al.
4,535,577 A 8/1985 Tenser et al.
4,567,698 A 2/1986 Morrison
4,571,907 A 2/1986 DeFouw et al.
4,607,753 A 8/1986 Radek
4,642,963 A * 2/1987 Borges ..... 52/481.2
4,685,255 A 8/1987 Kelley
4,876,835 A 10/1989 Kelley et al.
5,038,539 A 8/1991 Kelley et al.
5,400,560 A * 3/1995 Hellwig et al. ..... 52/578
6,131,347 A 10/2000 Hornberger et al.
6,158,178 A * 12/2000 Jeffers et al. ..... 52/220.7

FOREIGN PATENT DOCUMENTS

EP 0027001 4/1981
FR 2508524 12/1982
GB 1562395 3/1980

OTHER PUBLICATIONS

Teknion Furniture Systems, Inc. Brochure, 1982.
Teknion Office Furniture Systems, Price List, Apr. 1983.

* cited by examiner

FIG. 6
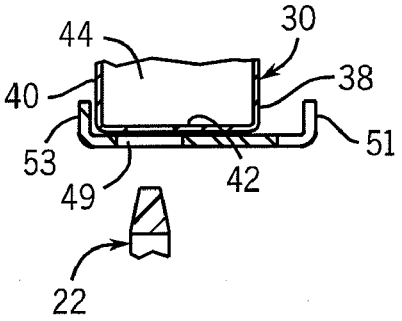
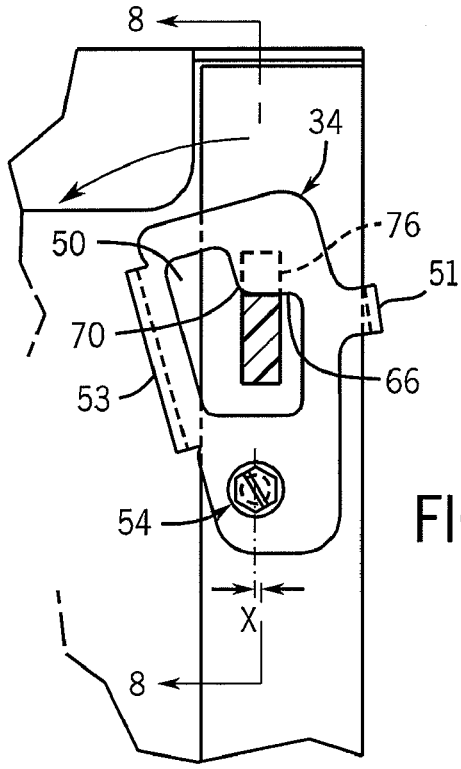
FIG. 7
FIG. 8
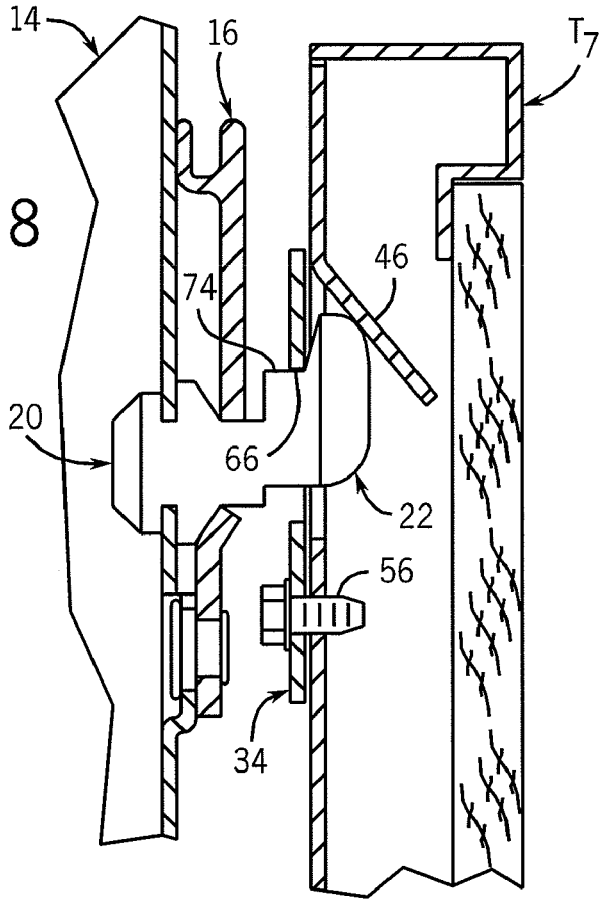

LATCH-TYPE TILE MOUNTING SYSTEM

BACKGROUND AND SUMMARY OF THE INVENTION

This invention relates to removable tiles incorporated in a wall panel partition system, and more particularly relates to a system for securing tiles to a wall panel.

Panel-type wall systems are commonly used to divide space in an open-plan office arrangement. In a typical panel-type wall system, a number of wall panels are interconnected together in a configuration suitable for the intended use of the space. Each wall panel typically includes a structural frame to which a series of tiles are mounted. The tiles may be broadly classified as either decorative tiles or functional tiles. Decorative tiles typically have an acoustic insulating material covered by an appropriate finishing material such as fabric, metal or wood, and are designed to provide soundproofing and an aesthetic outward appearance. Functional tiles generally have a frame that supports a functional component, such as a tool rail, one or more hooks, an opening, a window, a shelf, a markerboard, paper management components, etc.

In attaching functional tiles to a wall panel system, it is advantageous to secure the tiles to the frame of the wall panel partition system so that the tiles, which may be heavy, expensive, or both, are positively secured to the frame. Inadvertent placement of a functional tile on a frame without a properly secure connection may not provide adequate support and could allow a functional tile to fall, causing damage or injury to workers or items in the vicinity of the tile. If the functional tile has incorporated a glass component, or other non-shatterproof element, the risk of damage or injury arising from an improperly secured tile is equally to be avoided. It is also advantageous to provide a secure connection for functional tiles to a wall panel system in light of the fact that functional tiles are often more expensive options than typical decorative tile panels, and their loss or damage is less acceptable than damage to a decorative tile.

It is therefore one object of the present invention to provide a secure connection between the frame of a wall panel system and a tile, particularly a functional tile. It is another object of the invention to provide a self-correcting feature so that tiles are positively secured to the frame. Still another object of the invention is to provide a tile securing system that provides a secure, positive connection, but also allows tiles to be removable from the wall panel system with relative ease. A further object of the invention is to provide a tile securing system with a foolproof feature which is simple in its components and construction and yet which provides a high degree of tile security. It is yet another object of the invention is to provide a positive tile securing system that does not interfere with the aesthetic appearance of the tile when installed in the wall panel system.

In accordance with the invention, a tile mounting system for a wall panel system includes a latch member interposed between the tile and a frame incorporated in the wall panel system. The latch member is mounted to the tile, and is movable from an open position to a closed position. With the latch member in its open position, the tile is adapted to be engaged with a hook that extends outwardly from the frame of the wall panel system. The latch member is then moved to its closed position, which is operable to engage the hook to prevent the tile from being disengaged from the frame. The tile frame preferably includes an opening or slot that receives the hook of the frame. A blocking member, which may be in the form of a finger segment, is located in each opening or slot, and is configured to engage the hook to prevent full engagement of the hook with the tile frame. With this arrangement, an installer putting a tile into place must move the latch member to its closed position in order for the tile to be retained in position on the frame. The latch member is quickly and easily movable from its open position to its closed position and vice versa, to facilitate mounting and removal of the tile to and from the frame. The latch member is small and unobtrusive, and is located between the frame and tile so that only a small tab of the latch member is exposed when the tile is in place. The latch member is a simple, relatively lightweight device that can be attached to the tile in a variety of traditional ways, such as by a screw that defines a pivot axis about which the latch member is movable between its open and closed positions. In one embodiment, the finger segment of the opening or slot is formed of the material of the tile frame in which the opening or slot is formed, and the finger segment is bent or deflected inwardly relative to the adjacent edges of the tile frame material.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 6 is a partial section view taken along line 6—6 of FIG. 4;

FIG. 7 is a view similar to FIG. 4, showing movement of the latch member to its closed position for engaging the tile frame with the hook; and FIG. 8 is a partial section view taken along line 8—8 of FIG. 7.

DETAILED DESCRIPTION OF THE INVENTION

Figure 1:
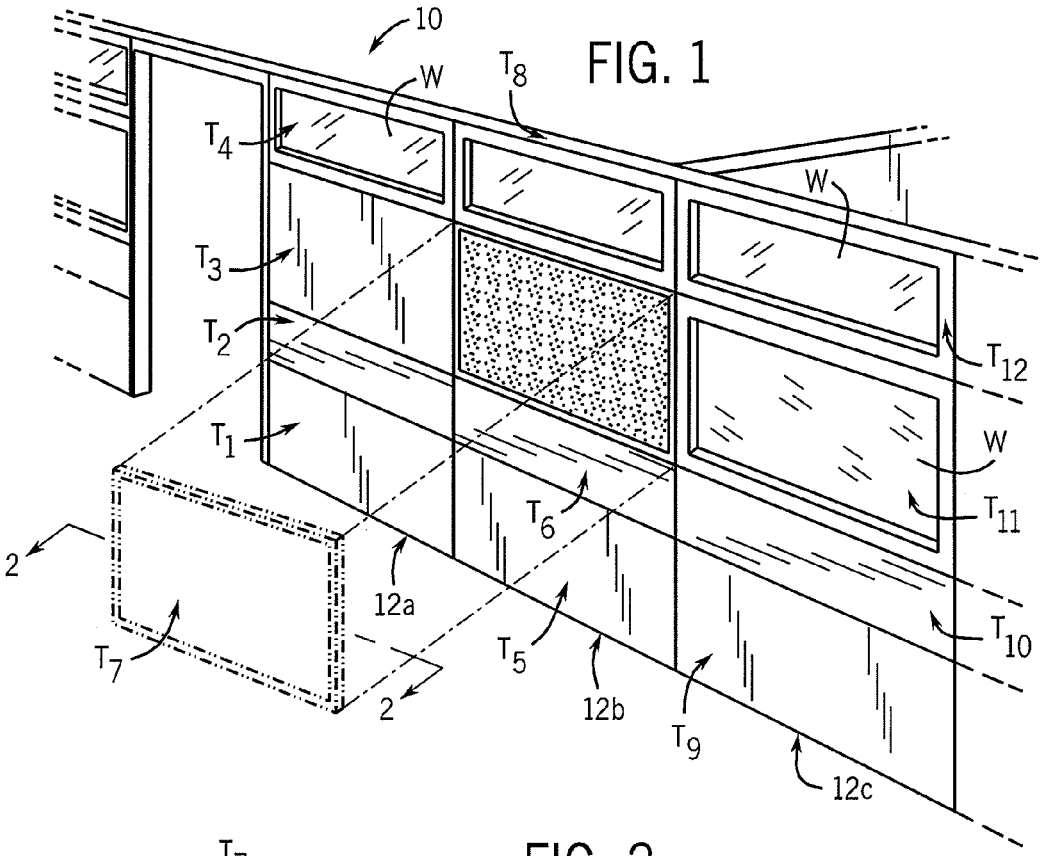
FIG. 1 is an isometric view of a tile-type wall panel system in which a series of tiles are engaged with wall panel frame, showing a tile having a latch-type mounting system according to the invention prior to engagement with the wall panel frame.

Referring to FIG. 1, a panel-type wall system, shown generally at 10, is adapted to be positioned within an open interior space for dividing the space, such as for use in an office environment or the like. Wall system 10 includes a series of wall sections or panels, such as illustrated at 12*a*, 12*b* and 12*c*, which are located adjacent each other and interconnected so as to form a rigid wall, in a manner as is known. Representatively, the general construction of wall system 10 may be such as is available from Krueger International, Inc. of Green Bay, Wis. under its designation WIREWORKS, which is shown and described in Hornberger et al U.S. Pat. No. 6,115,977 issued Sep. 12, 2000, the disclosure of which is hereby incorporated by reference.

Figure 5:
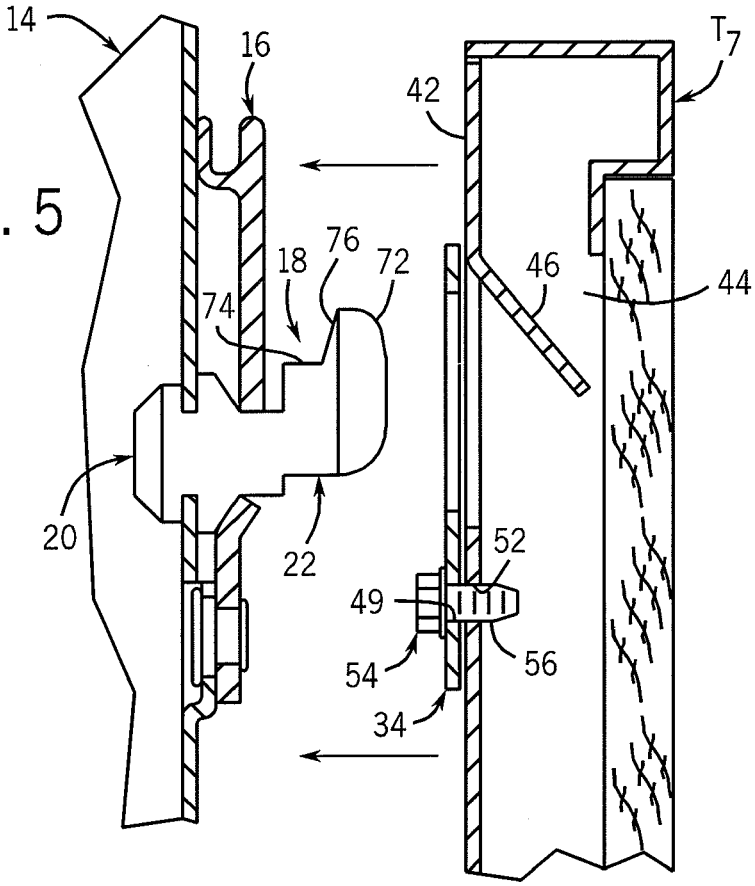
FIG. 5 is a partial section view taken line 5—5 of FIG. 4 and illustrating a portion of the panel system frame, which includes an outwardly extending hook with which the tile is adapted to be engaged.

Wall system 10 is generally constructed of a structural frame system that includes a pair of parallel vertical frame members and a series of horizontal frame members that extend between each pair of vertical frame members. FIGS. 5 and 8 illustrate a section of one of the vertical frame members, shown at 14 as well as one of the horizontal frame members, shown at 16, which is secured at one end to the vertical frame member such as 14. Also as shown and described in the '977 patent, a hook member 18 is located at the connection of horizontal frame member 16 to vertical frame member 14. Hook member 18 includes a base section 20 that is engageable within aligned openings defined by vertical frame member 14 and horizontal frame member 16, in combination with an outwardly extending hook section 22 that extends outwardly of horizontal frame member 16.

Hook members 18 are adapted for use in mounting a series of tiles to each frame of wall system 10, to cover the frame and enclose the internal space defined by the frame. Generally, each section or panel of wall system 10 may have any number of tiles mounted to each side of the frame, and the tiles may be decorative or aesthetic, or may have a functional feature, in a manner as is known. In the embodiment illustrated in FIG. 1, panel 12*a* of wall system 10 includes vertically aligned decorative tiles $T_1$, $T_2$ and $T_3$, and an upper functional tile $T_4$, which includes a transparent window W. Decorative tiles $T_1$, $T_2$ and $T_3$ are primarily designed to cover the components of the frame of wall panel 12*a* and to conceal the internal space defined by the frame. Representatively, the decorative tiles T may have a construction as illustrated in the '977 patent. In addition to serving an aesthetic or decorative purpose, tile $T_1$, $T_2$ and $T_3$ also provide an acoustic barrier function to minimize the transmission of sound through wall system 10.

A tile similar to window tile $T_4$ is engaged with the opposite side of the frame of wall panel 12*a* in alignment with window panel $T_4$, such that the aligned window panels W function to transmit light through the upper area of wall panel 12*a*.

Wall panel 12*b* includes decorative tiles $T_5$ and $T_6$ toward its lower end, which are similar in construction and configuration to decorative tiles $T_1$, and $T_2$. A functional tile $T_7$ is engaged with the frame of wall panel 12*b* above decorative tile $T_6$, and a window tile $T_8$, which is similar to window tile $T_4$, is engaged with the frame of wall panel 12*b* above functional tile $T_7$. Wall panel 12*c* also includes decorative panels $T_9$ and $T_{10}$ toward its lower end, which are similar in construction and configuration to decorative tiles $T_1$, $T_2$ and $T_5$, $T_6$, respectively. In addition, a functional tile $T_{11}$ is engaged with the frame of wall panel 12*c* above decorative tile $T_{10}$, and includes a window W in a manner similar to tiles $T_4$ and $T_8$. Another functional window tile $T_{12}$ is engaged with the frame of wall panel 12*c* above window tile $T_{11}$, and is constructed similarly to window tiles $T_4$ and $T_8$.

It is understood that the sizes, configuration and arrangement of the tiles mounted to the panel frames of wall system 10 are representative of a virtually unlimited number of tile configurations and arrangements which may be engaged with the wall panel frames of wall system 10. It is further understood that the various functional tiles of wall system 10 may serve a number of different functions according to user requirements and the intended utilization of the space defined by wall system 10. The functional tiles may be in the form of window tiles as illustrated, and other examples include shelf tiles, marker board tiles, cabinet tiles, pass-through tiles, heater tiles, fan tiles, etc. Again, the specific function of each functional tile, such as tile $T_7$ as well as tiles $T_4$, $T_8$, $T_{11}$ and $T_{12}$, is known in the prior art, and other types of functional tiles than those currently known may be developed.

The decorative tiles of wall system 10, which include tiles $T_1$, $T_2$, $T_3$, $T_5$, $T_6$, $T_9$, and $T_{10}$, are engaged with the wall panel frame as shown and described in the '977 patent. In this construction, a slot is located at each corner of the decorative tile, and is configured to receive the outwardly extending hook portion 22 of each hook member 18, to removably mount the decorative tile to the wall panel frame. The functional tiles of wall system 10, which includes tile $T_7$ as well as window tiles $T_4$, $T_8$, $T_{11}$ and $T_{12}$, incorporate a latch-type mounting system in accordance with the present invention, to provide a secure releasable connection of each functional tile to the wall panel frame.

Figure 2:
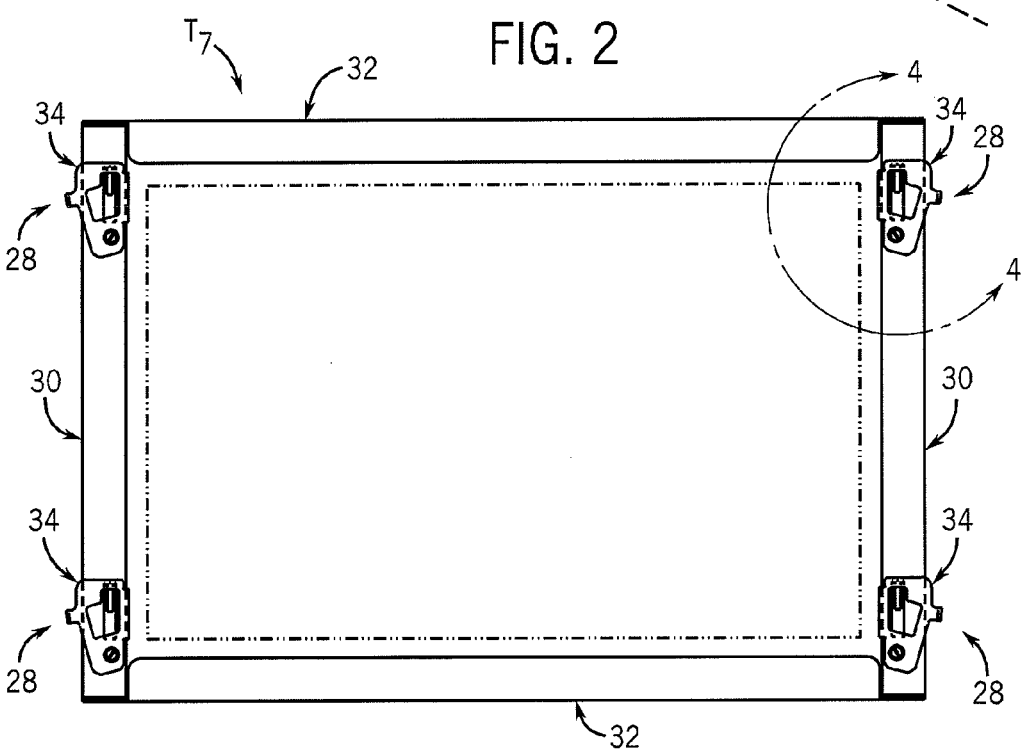
FIG. 2 is a rear elevation view of a tile incorporating the latch-type mounting system of the present invention, with reference to line 2—2 of FIG. 1.
Figure 3:
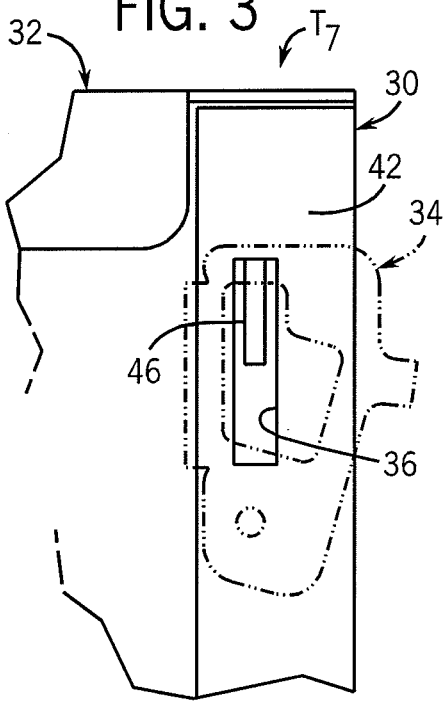
FIG. 3 is an enlarged partial rear elevation view of a portion of the tile of FIG. 2, showing a corner area of the tile and the construction of the tile frame in the area at which a latch member, forming a part of the latch-type tile mounting system, is adapted to be positioned.

In accordance with the present invention, each functional tile, such as tile $T_7$ as well as tiles $T_4$, $T_8$, $T_{11}$ and $T_{12}$, includes a latch-type mounting arrangement, shown generally at 28 (FIG. 2) at each of its corners where the functional tile is adapted to engage one of hook members 18. The latch-type mounting arrangements 28 are adapted to provide positive securement of each functional tile to its associated wall panel frame, so as to prevent the functional tiles from being inadvertently removed from engagement with the wall panel frame, to prevent damage to the functional tile. In addition, latch-type mounting arrangements 28 function to ensure that each functional tile is properly engaged with hook members 18 upon installation. In the illustrated embodiment, a latch-type tile mounting arrangement 28 is shown at each corner of tile $T_7$. It is also contemplated that latch-type tile mounting arrangements 28 may be provided at only selected areas on the tile, e.g. at the top corners, at the bottom corners, at diagonally opposite corners, or at the corners on only one side of the tile. In any of these embodiments, a conventional slot is provided at the corners which do not have a latch-type tile mounting arrangement 28, to receive hook section 22 in a known manner. In a commercial embodiment of the invention, latch-type mounting arrangements 28 are provided on the corners on one side of the tile, and conventional slots are formed in the tile on the opposite side.

Each functional tile includes a frame or other structure that defines the edges of the tile and which provides the required degree of rigidity to the tile as well as the structure to which the functional tile component is mounted. In the illustrated embodiment, the tile frame includes a pair of spaced apart vertical side members 30 and a pair of spaced apart horizontal side members 32. Each latch-type mounting arrangement 28 includes a movable latch member 34, and mounting arrangements 28 are configured such that an upper pair of latch members 34 are mounted toward the upper end of each vertical side member 30 and a lower pair of latch members 34 are movably mounted toward the lower end of each vertical side member 30. Each latch member 34 is mounted over a slot 36 defined by its associated vertical side member 30. In the illustrated embodiment, each side member 30 is formed of stamped and bent sheet metal to define a structural channel section at the edge of the tile, in accordance with known technology. With this construction, side member 30 includes a series of walls that are bent relative to each other, including an outer side wall 38, an inner side wall 40 and a rear side wall 42, which cooperate to define an internal space 44, as shown in FIG. 6. Slot 36 is formed in rear side wall 42. Illustratively, slot 36 may be formed via a stamping operation simultaneously with the stamping operation in which the blank sheet metal is stamped to produce the structural components of tile $T_7$, although it is understood that any other satisfactory type of forming method may be employed. It is also understood that the specific construction of vertical side members 30 and horizontal side members 32 may vary from that which is shown and described, and also that slot 36 may be formed in any component of the tile located toward the tile corner, e.g. in an appropriately located section of upper horizontal side member 32 or in a molded plastic connector which is used to interconnect the horizontal and vertical side members.

A blocking member, in the form of a blocking finger 46, is located in each slot 36. As shown in FIGS. 5 and 6, blocking finger 46 extends downwardly and inwardly from the upper edge of slot 36, into the internal space 44 defined by walls 38–42. In a manner to be explained more fully hereafter, blocking finger 46 prevents engagement of hook portion 22 of hook member 18 with the upper edge of slot 36.

Figure 4:
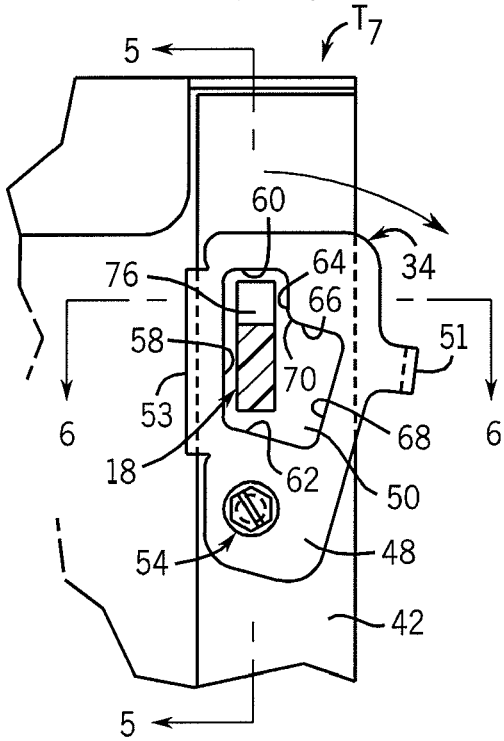
FIG. 4 is an enlarged partial rear elevation view similar to FIG. 3 showing a latch member positioned on the tile frame and in an open position, with reference to line 4—4 of FIG. 2, and showing in cross-section a hook member forming a part of the latch-type mounting system of the present invention.

Referring to FIGS. 4 and 7, latch member 34 includes a generally planar body having a lower mounting section 48 and an upper section within which an opening 50 is formed. In addition, latch member 34 includes a forwardly extending engagement tab 51 located outwardly of outer side wall 38, and an inner stop wall 53 located inwardly of inner side wall 40. Representatively, latch member 34 may be formed of a stamped and bent section of sheet metal material, although it is understood that other satisfactory materials and forming methods may be employed.

Lower mounting section 48 includes an opening 49 (FIG. 6), which is adapted to be placed into alignment with an opening 52 formed in rear side wall 42 of vertical side member 30. A fastener 54 includes a threaded shank 56 that extends through aligned openings 49 and 52, into threaded engagement with the edge of opening 52 so as to secure latch member 34 to vertical side member 30. In this manner, fastener shank 56 defines a pivot axis about which latch member 34 is movable between an open or unlocked position as shown in FIG. 4, and a closed or locked position as shown in FIG. 7.

Opening 50 in latch member 34 is configured to define an inner hook receiving area and an outer hook engaging area. The inner hook receiving area of opening 50 is defined by a side edge 58, an upper edge 60 and a lower edge 62, in combination with a partial side edge 64 that extends downwardly from upper edge 60. The outer hook engaging area of opening 50 is defined by an upper engagement edge 66 that extends outwardly from the lower end of partial side edge 64, in combination with an outer side edge 68 that extends between upper engagement edge 66 and lower edge 62. A rounded corner 70 is located between the lower end of partial side edge 64 and the inner end of upper engagement edge 66.

In operation, latch-type mounting arrangement 28 functions as follows to positively secure a tile, such as a functional tile $T_7$, to wall system 10. Each latch member 34 is initially moved to its open or unlocked position of FIG. 4, in which the inner hook receiving area of opening 50 is located in alignment with slot 36 in vertical side member 30. To accomplish this, the user manually engages tab 51 and applies an outward force to latch member 34, to pivot latch member 34 about the pivot axis defined by fastener shank 56. Stop wall 53 engages inner side wall 40 of vertical side member 30, as shown in FIG. 6, to limit the outward pivoting movement of latch member 34. Stop wall 53 is configured and arranged such that, when engaged with inner side wall 40 in this manner, the inner hook receiving area of opening 50 is in alignment with slot 36. Tile $T_7$ is then moved toward hook members 18 in the direction of the arrows shown in FIG. 5, until hook portion 22 passes through the hook receiving area of opening 50 and through slot 36. The upper outer area of hook member 22, shown at 72, contacts the rearwardly facing surface of blocking finger 46, as shown in FIG. 8, which prevents engagement of hook portion 22 with the upper edge of slot 36. In this manner, such initial positioning of hook portion 22 within slot 36 is unable to engage tile $T_7$ with hook members 18. When each hook member 18 is initially positioned within its associated slot 36 in this manner, such that the upper outer surface 72 of hook member 18 is in engagement with blocking finger 46, the user manually engages tab 51 to move latch member 34 from its open, unlocked position of FIG. 4 to its closed, locked position of FIG. 7, by pivoting latch member 34 in an inward direction about the pivot axis defined by fastener shank 56. Tab 51 is moved inwardly into engagement with outer side wall 38 of vertical side member 30, such that tab 51 acts as a stop member to properly position latch member 34 in its closed or locking position.

When latch member 34 is moved to its closed or locked position in this manner, upper engagement edge 66 is positioned so as to engage the upwardly facing engagement surface of hook member 18, shown at 74 (FIGS. 5 and 8). The rounded configuration of comer 70 provides a guide surface which facilitates such movement of latch member 34, so as to guide latch member 34 to the proper elevation to locate engagement edge 66 in vertical alignment with hook engagement surface 74. When latch member 34 is moved to its closed or locked position of FIG. 7 in this manner, the material of latch member 34 located vertically above engagement edge 66 is in alignment with the upper section of hook portion 22, shown at 76, that extends upwardly from engagement surface 74, to prevent tile $T_7$ from being moved outwardly relative to the frame members 14, 16 of wall system 10. This ensures that tile $T_7$ is positively maintained in engagement with the frame of wall panel 12*b*, and prevents inadvertent disengagement or dislodgment of tile $T_7$. The space between the lower surface of hook portion 22 and lower edge 62 of opening 50 is less than the height of upper section 76 of hook portion 22, such that tile $T_7$ cannot be moved upwardly and forwardly out of engagement with hook portion 22 of hook member 18.

When latch member 34 is in its closed or locked position, the force applied to engagement edge 66 by hood engagement surface 74 is offset by a distance X from the pivot axis defined by fastener shank 56. Referring to FIG. 7, this offset functions to apply a counterclockwise moment to latch member 34 which tends to maintain latch member 34 in its closed or locked position. In this manner, latch member 34 is prevented from being accidentally moved to its open position or working loose over time.

In order to enable disengagement of tile $T_7$ from the frame of wall panel 12*b*, the user manually applies an outward force to tab 51, to pivot latch member 34 from its closed or locked position of FIG. 7 to its open or unlocked position of FIG. 4. The area of latch member 34 above engagement edge 66 is thus moved out of alignment with upper section 76 of hook portion 22, to enable tile $T_7$ to be moved outwardly relative to hook portion 22 and thereby disengaged from the frame of wall panel 12*b*. Stop wall 53 engages inner side wall 40 of vertical side member 30 when latch member 34 is moved outwardly in this manner, to place latch member 34 in its open or unlocked position.

While the invention has been shown and described with respect to a specific embodiment, it is understood that numerous variations are possible and are contemplated as being with in the scope of the present invention. For example, and without limitation, latch-type mounting arrangement 28 may be employed in connection with any type of hook member or other protrusion having a hook-type configuration that extends outwardly from a wall panel frame, and is not limited to use in connection with the specific type of hook member 18 as shown and described. The hook may serve the function of maintaining horizontal and vertical frame members together as in the illustrated embodiment, or may be a hook member that mounts to either a horizontal frame member or a vertical frame member in any location and which may or may not have a similar frame member engagement feature, or may have other features or any other type of arrangement for mounting the hook member to the frame members of the wall panel. Further, the details and specific construction of latch member 34 may vary from that which is shown and described. While latch member 34 is illustrated as being a generally planar member having a specifically configured opening and which is pivotably mounted to the frame via a fastener, other configurations and mounting arrangements are possible. For example, a movable latch member may be mounted to the wall panel frame at the location of each hook, and not to the frame or other structure of the tile. The latch member may be a component that is separate from the hook and engageable with the frame, or may be incorporated into a hook and latch member assembly that is engageable with the frame. Further, latch member 34 may have a configuration other than the planar configuration as shown and described, and the particular configuration of opening 50 may vary from the specific configuration as illustrated. For example, opening 50 may be replaced with a suitably configured slot, so long as the configuration is such as to maintain positive engagement with hook portion 22 of hook member 18 when in its closed or locked position and enables outward movement relative to hook member 18 when in its open or unlocked position. The particular configuration and location of stop wall 53 and tab 51 may also vary from that as illustrated, so long as the latch member includes engagement structure which is operable to position the latch member in its open or unlocked position as well as its closed or locked position. While fastener 54 is shown in defining the latch member pivot axis, it is understood that any other type of movable engagement arrangement may be employed for providing movement of latch member 34 between its open or unlocked position and its closed or locked position. In a pivoting configuration, any type of mating projection and opening arrangement may be employed, in which either component is located on either the latch member or the structure to which the latch member is mounted. The latch member may also be movable in a sliding manner between its open and closed positions. In a configuration such as this, a sliding engagement arrangement is provided between the latch member and the structure to which the latch member is mounted, e.g. a tongue and slot configuration or the like. Further, while slot 36 and blocking finger 46 are shown as being formed in and from the material of rear side wall 42 of vertical side member 30, it is understood that numerous variations are possible for the slot and blocking member. For example, the slot may be formed in a molded plastic corner member forming a part of the tile frame, and including a ramped surface such as that defined by blocking finger 46 which prevents engagement with the upwardly facing engagement surface such as 74 of the hook member. Further, while the latch-type tile mounting system has been shown and described in connection with mounting of functional tiles to a wall panel frame, it is understood that the latch-type mounting system may also be used to mount decorative or other types of tiles to a wall panel frame, or to any other structure.

Various alternatives and embodiments are contemplated as being within the scope of the following claims particularly pointing out and distinctly claiming the subject matter regarded as the invention.

I claim:

1. A tile mounting system for securing a tile to a wall panel frame, comprising:

a wall panel frame including an outwardly extending hook member having an outer hook portion, wherein the hook member defines an engagement surface;

a hook receiver associated with the tile, wherein the hook receiver defines an opening configured to receive at least the outer hook portion of the hook member; and a latch member carried by the tile and interposed between the tile and the wall panel frame, wherein the latch member is movable between a locked position and an unlocked position, and wherein the latch member is configured to enable the outer hook portion of the hook member to be received within the hook receiver opening when in the unlocked position, and wherein the latch member is further configured to prevent removal of the outer hook portion from the hook receiver opening when in the locked position;

wherein the latch member includes engagement structure that engages the engagement surface of the hook member when the latch member is in the locked position so as to positively retain the tile in engagement with the hook member and to thereby secure the tile to the wall panel frame, and wherein the hook receiver further includes blocking structure that prevents engagement between the hook receiver and the engagement surface of the hook member when the outer hook portion of the hook member is moved into the hook receiver opening.

2. The tile mounting system of claim 1, wherein the latch member defines an opening configured to receive the outer hook portion when the latch member is in the unlocked position, and wherein the engagement structure of the latch member comprises an engagement edge defined by the opening which engages the engagement surface of the hook member when the latch member is in the locked position.

3. The tile mounting system of claim 2, wherein the tile includes one or more structural frame members, and wherein the hook receiver opening comprises a slot associated with one of the structural frame members.

4. The tile mounting system of claim 3, wherein the blocking structure comprises a ramped surface located in an upper area defined by the slot, wherein the ramped surface is configured to prevent engagement with the engagement surface of the hook member.

5. The tile mounting system of claim 4, wherein the structural frame member includes a rearwardly facing wall, and wherein the slot is formed in the rearwardly facing wall and the blocking structure comprises a blocking finger that extends inwardly from an upper area defined by the slot, wherein the blocking finger is formed by an inwardly extending area of the rearwardly facing wall of the structural frame member.

6. The tile mounting system of claim 2, wherein the latch member opening includes a hook receiving area configured to receive the outer hook portion of the hook member when the latch member is in the unlocked position, and a hook engagement portion defined in part by the engagement edge, wherein the engagement edge engages the engagement surface of the hook member when the latch member is in the locked position.

7. The tile mounting system of claim 6, wherein the opening includes a curved surface defining a transition to the engagement edge for facilitating engagement of the engagement surface of the hook member with the engagement edge when the latch member is moved to the locked position.

8. The tile mounting system of claim 6, wherein the tile includes a structural member to which the latch member is mounted, wherein the structural member defines a pair of spaced apart surfaces, and wherein the latch member includes stop structure configured to engage the spaced apart surfaces of the structural member, wherein the stop structure operable to position the latch member in the locked position and in the unlocked position.

9. The tile mounting system of claim 8, wherein the latch member defines a generally planar surface located adjacent the structural member of the tile within which the opening is formed, and wherein the stop structure comprises a pair of stop members extending from the planar surface and configured to engage the spaced apart surfaces defined by the structural member.

10. The tile mounting system of claim 9, wherein the latch member is pivotably mounted to the structural member of the tile.

11. The tile mounting system of claim 10, wherein the latch member is mounted to the structural member of the tile via a fastener, wherein the fastener defines a pivot axis about which the latch member is pivotable between the locked and unlocked positions.

12. The tile mounting system of claim 9, wherein the structural member of the tile is located adjacent an edge of the tile and wherein the spaced apart surfaces defined by the structural member comprise an inner wall and an outer wall, wherein a first one of the stop members is configured to engage the inner wall to position the latch member in the unlocked position and a second one of the stop members is configured to engage the outer wall to position the latch member in the locked position, wherein the second stop member is manually accessible from the exterior of the tile so as to enable a user to manually engage the second stop member for moving the latch member between the locked and unlocked positions.

13. A method of mounting a tile to a wall panel frame, comprising the acts of:

interconnecting a hook member with the wall panel frame such that an outer hook portion of the hook member extends outwardly from the wall panel frame, wherein the hook member includes an engagement surface;

providing a tile including a hook receiver that defines an opening configured to receive at least the outer hook portion of the hook member, and, a latch member that is movable between a locked position and an unlocked position;

moving the tile toward the wall panel frame with the latch member in the unlocked position, wherein the latch member faces the wall panel frame and wherein movement of the tile toward the wall panel frame causes movement of the outer hook portion of the hook member into the opening of the hook receiver; and moving the latch member from the unlocked position, in which the latch member enables the outer hook portion of the hook member to be received within the opening defined by the hook receiver, to a locked position, wherein the latch member in the locked position is configured to engage the engagement surface of the hook member to positively retain the tile in engagement with the hook member and to thereby secure the tile to the wall panel frame, and to prevent removal of the outer hook portion of the hook member from the hook receiver;

wherein the hook receiver and the hook member are configured to prevent engagement between the engagement surface of the hook member and the hook receiver in a manner sufficient to secure the tile to the wall panel when the outer hook portion of the hook member is moved into the opening of the hook receiver.

14. The method of claim 13, wherein the latch member is mounted adjacent an edge of the tile and includes a manual engagement structure located outwardly of the tile edge, wherein the act of moving the latch member between the unlocked and locked positions is carried out by manually engaging the manual engagement structure and moving the latch member between the unlocked and locked positions.

15. The method of claim 13, wherein the latch member pivotably mounted to the tile, and wherein the act of moving the latch member is carried out by pivoting the latch member between the unlocked and locked positions.

16. The method of claim 13, wherein the latch member includes stop structure, and wherein act of moving the latch member between the unlocked and locked positions includes engaging the stop structure with surfaces of the tile for positioning the latch member in the unlocked and locked positions.

17. The method of claim 13, wherein the act of moving the latch member to the locked position is carried out such that a portion of the latch member adjacent the opening is in alignment with the outer hook portion of the hook member to prevent removal of the outer hook portion of the hook member from the hook receiver.

18. The method of claim 13, wherein the engagement surface of the hook member faces upwardly, and wherein the act of moving the latch member to the locked position functions to position an engagement edge of the latch member over the engagement surface.

19. In a wall system including one or more wall panels, each of which includes a frame, wherein at least one tile is adapted to be releasably secured to the frame, the improvement comprising a hook member interconnected with the wall panel frame and including an engagement surface and an outer hook portion; receiver structure associated with the tile and defining a receiver cavity adapted to receive at least the outer hook portion of the hook member, wherein the hook member and the receiver cavity are configured to prevent engagement between the engagement surface of the hook member and the tile; and a movable latch member carried by the tile and interposed between the receiver and the hook member, wherein the latch member is movable between an unlocked position in which the latch member enables the outer hook portion of the hook member to pass into and out of the receiver cavity, and a locked position in which the latch member engages the engagement surface of the hook member so as to retain the tile in engagement with the hook member and to prevent removal of the outer hook portion from the hook receiver opening, and wherein the hook receiver further includes blocking structure that prevents engagement between the hook receiver and the engagement surface of the hook member when the outer hook portion of the hook member is moved into the receiver cavity.

20. The improvement of claim 19, wherein the blocking structure comprises an angled upper surface within the receiver cavity that engages an upper surface defined by the outer hook portion of the hook member so as to prevent engagement between the hook receiver and the engagement surface defined by the hook member.

21. The improvement of claim 20, wherein the hook receiver cavity is accessible via a slot formed in a wall associated with the tile, and wherein the angled upper surface comprises a finger formed integrally with the wall of the tile.

22. The improvement of claim 19, wherein the latch member defines an engagement edge which is located in alignment with the engagement surface defined by the hook member when the latch member is in the locked position.

23. The improvement of claim 22, wherein the latch member defines an opening configured to enable the outer hook portion of the hook member to pass therethrough when the latch member is in the unlocked position, and wherein the engagement edge of the latch member forms an edge of the opening which is movable into engagement with the engagement surface defined by the hook member when the latch member is in the locked position.

24. The improvement of claim 22, wherein the latch member includes a pair of stop members which engage spaced apart surfaces defined by the tile, wherein engagement of the stop members with the spaced apart surfaces is operable to place the latch member in the locked and unlocked positions.

25. The improvement of claim 23, wherein the latch member is mounted to the tile for pivoting movement between the locked and unlocked positions via a fastener that functions to secure the latch member to the tile.

26. The improvement of claim 24, wherein a first one of the stop members is located outwardly of an edge defined by the tile and is manually accessible by a user for enabling the user to move the latch member between the locked and unlocked positions.

* * * * *